US009815666B2

(12) United States Patent
Meunier

(10) Patent No.: US 9,815,666 B2
(45) Date of Patent: Nov. 14, 2017

(54) EMERGENCY MOVEMENT DEVICE FOR AN ELEVATOR OR LIFT

(71) Applicant: TRUST <T> LIFT CORP., Edmonton (CA)

(72) Inventor: Richard Meunier, Edmonton (CA)

(73) Assignee: Trust <T> Lift Corp., Edmonton, Alberta (CA)

( * ) Notice: Subject to any disclaimer, the term of this patent is extended or adjusted under 35 U.S.C. 154(b) by 63 days.

(21) Appl. No.: 14/826,390

(22) Filed: Aug. 14, 2015

(65) Prior Publication Data

US 2016/0376126 A1 Dec. 29, 2016

(30) Foreign Application Priority Data

Jun. 25, 2015 (CA) ..... 2894977

(51) Int. Cl.
*B66B 11/04* (2006.01)
*B66B 5/02* (2006.01)

(52) U.S. Cl.
CPC ..... *B66B 11/0415* (2013.01); *B66B 5/027* (2013.01)

(58) Field of Classification Search
CPC ..... B66B 5/027; B66B 11/0415
See application file for complete search history.

(56) References Cited

U.S. PATENT DOCUMENTS 4,051,923 A * 10/1977 Blanchette ..... B66B 5/027 187/271
4,133,437 A * 1/1979 Gates ..... B60P 1/4428 187/200
4,493,603 A * 1/1985 Williams ..... A61G 3/06 414/541
4,592,450 A * 6/1986 Schaffer ..... B66B 5/027 187/263
5,680,911 A * 10/1997 Wang ..... B66B 5/04 187/263
5,713,433 A * 2/1998 Wang ..... B66B 5/027 187/263
5,890,565 A * 4/1999 Wang ..... B66D 5/24 187/263

(Continued)

*Primary Examiner* — Minh Truong
(74) *Attorney, Agent, or Firm* — Davis & Bujold PLLC; Michael J. Bujold

(57) ABSTRACT

An emergency movement device for a lift has a mounting body attached to the lift and a pivoting body pivotally attached to the mounting body. A gear box with an output drive shaft for engaging a main drive of the lift is provided. The output drive shaft is movable in conjunction with the pivoting body. The pivoting body is movable between an engaging position in which the output drive shaft engages the main drive to allow for rotation of the main drive of the lift and a non-engaging position in which the output drive shaft is disconnected from the main drive. An input shaft is provided and has a first end and a second end. The first end is connected to the gear box to allow rotation of the input shaft which causes rotation of the output drive shaft. An input shaft support is positioned on the lift for providing support to the input shaft so that the input shaft is supported in a substantially horizontal orientation. A biasing spring is provided in communication with the pivoting body for biasing the pivoting body and the output drive shaft in the non-engaging position.

14 Claims, 2 Drawing Sheets

(56) References Cited

U.S. PATENT DOCUMENTS

| | | | | |
|---|---|---|---|---|
| 6,116,380 | A * | 9/2000 | Wang | B66B 5/027 187/263 |
| 6,273,216 | B1 * | 8/2001 | Kocher | B66B 5/027 187/254 |
| 6,464,043 | B2 * | 10/2002 | Wang | B66B 5/027 187/263 |
| 2007/0227827 | A1 * | 10/2007 | Madoz Michaus | B66B 5/027 187/277 |

* cited by examiner

EMERGENCY MOVEMENT DEVICE FOR AN ELEVATOR OR LIFT

FIELD OF THE DISCLOSURE

The present application relates generally to a manual device for moving an elevator or lift in the event of an emergency or power outage.

BACKGROUND

This section provides background information to facilitate a better understanding of the various aspects of the invention. It should be understood that the statements in this section of this document are to be read in this light, and not as admissions of prior art.

It is often desirable to have a secondary means of manually operating a lift or elevator. In most cases, this manual operation is required to meet national safety codes in Canada and the United States. Safe and convenient access to operate these devices can be difficult to achieve. This is particularly true for belt and screw drive elevators or lifts as the screw and motor shaft axis are mounted vertically. In many circumstances, accessing the emergency movement device is achieved by removing cover panels to gain access to the drive and reaching over the tower or standing on the lift platform to manually activate the emergency movement device. For tall tower lifts and elevators, this procedure is often difficult, resulting in the need for an expensive access panel cut into the tower support wall.

BRIEF SUMMARY

There is provided an emergency movement device for a lift that is used for manually operating a lift or elevator. The device includes a mounting body attached to the lift and a pivoting body pivotally attached to the mounting body. A gear box is provided that has an output drive shaft for engaging a main drive screw of the lift. The output drive shaft is movable in conjunction with the pivoting body. The pivoting body is movable between an engaging position in which the output drive shaft engages the top of the main pulley to allow for rotation of the main drive screw of the lift, and a non-engaging position in which the output drive shaft is disconnected from the main drive screw of the lift. An input shaft has a first end and a second end with the first end that is connected to the gear box such that rotation of the input shaft causes rotation of the drive screw. An input shaft support is provided on the lift for providing support to the input shaft such that the input shaft is supported in a substantially horizontal orientation. A biasing spring is provided in communication with the pivoting body for biasing the pivoting body and the output drive shaft in the non-engaging position.

The main drive may be a screw drive. The main screw drive is preferably vertical and is indirectly driven by a pulley, chain or other power transfer mechanism. When a pulley mechanism is used, the output drive shaft engages a pulley drive that is connected to the main drive. The output drive shaft may either directly or indirectly engage the main drive screw.

The biasing spring is provided for biasing the pivoting body and output drive shaft in the non-engaging position. While the biasing spring can be positioned on the device in any location in which it communicates with the pivoting body to bias it in the non-engaging position, it may be positioned on the input shaft.

A safety switch may be included on the device for preventing power from reaching the main drive when the emergency movement device is engaged. The safety switch is preferably attached to the input shaft support.

The input shaft may have an input shaft extension attached to the second end of the input shaft for elongating the input shaft. This allows for the overall length of the input shaft to be altered based upon the dimensions of the lift and the length of the input shaft that is preferred by the user. A handle may also be included for assisting in rotating the input shaft.

The first end of the input shaft may be connected to the gear box by a pivotal connection. The pivotal connection is preferably a flexible joint. The flexible joint helps to prevent the input shaft from losing its substantially horizontal orientation regardless of whether the pivoting body and output drive shaft are in the engaging position or the non-engaging position. Some vertical movement of the input shaft is to be expected when the pivoting body and output drive shaft are moved between the engaging position and the non-engaging position.

There is further provided an emergency movement device for a lift that has a mounting body attached to the lift and a pivoting body pivotally attached to the mounting body. A gear box is positioned on the pivoting body and is movable in conjunction with the pivoting body. The gear box has an output drive shaft for engaging a pulley drive connected to a main drive screw of the lift. The pivoting body is movable between an engaging position in which the output drive shaft engages the pulley drive to allow for rotation of the main drive screw of the lift and a non-engaging position in which the draft shaft is disconnected from the pulley drive. An input shaft has a first end and a second end. The first end is pivotally connected to the gear box to allow for rotation of the input shaft which causes rotation of the output drive shaft. An input shaft support is positioned on the lift for providing support to the input shaft to support the input shaft in a substantially horizontal orientation. A biasing spring is positioned on the input shaft for biasing the pivoting body and output drive shaft in the non-engaging position.

A safety switch may be included on the device for preventing power from reaching the main drive screw when the emergency movement device is engaged. The safety switch is preferably attached to the input shaft support.

The input shaft may have an input shaft extension attached to the second end of the input shaft for elongating the input shaft. This allows for the overall length of the input shaft to be altered based upon the dimensions of the lift and the length of the input shaft that is preferred by the user. A handle may also be included for assisting in rotating the input shaft.

The first end of the input shaft is connected to the gear box by a pivotal connection. The pivotal connection is preferably a flexible joint.

BRIEF DESCRIPTION OF THE DRAWINGS

These and other features will become more apparent from the following description in which references are made to the following drawings, in which numerical references denote like parts. The drawings are for the purpose of illustration only and are not intended to in any way limit the scope of the invention to the particular embodiments shown.

DETAILED DESCRIPTION OF THE PREFERRED EMBODIMENTS

Figure 1:
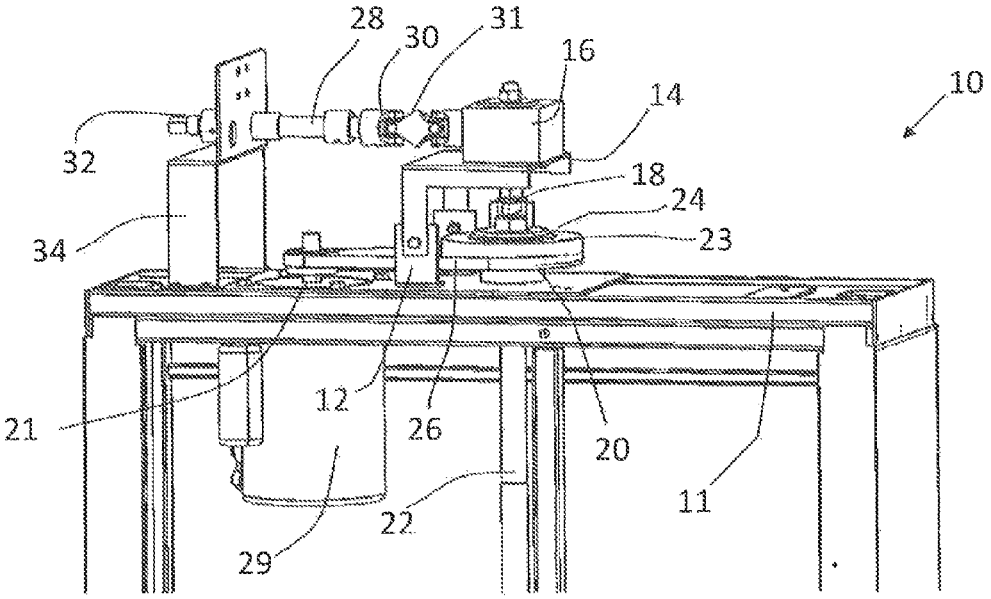
FIG. 1 is a perspective view of an emergency movement device attached to an elevator in the engaging position.

An emergency movement device for a lift, generally identified by reference numeral 10, will now be described with reference to FIG. 1 through FIG. 4.

Referring to FIG. 1, emergency movement device for a lift 10 has a mounting body 12 attached to lift 11 and a pivoting body 14 pivotally attached to mounting body 12. In the embodiment shown, lift 11 is an elevator, however it will be understood by a person skilled in the art that lift 11 may be any type of mechanical lifting device in which manual operation may be beneficial to the user. A gear box 16 is provided that has an output drive shaft 18 for engaging a main drive 20 of lift 11. Gear box 16 is shown positioned on pivoting body 14, however a person of skill will understand that gear box 15 may be positioned in other locations as long as output drive shaft 18 is movable with pivoting body 14. In the embodiment shown, main drive 20 is a vertical drive screw 22 that is engaged to a driven pulley 24 of a pulley drive 23. An electric motor 29 is attached to a drive pulley 21 that engages driven pulley 24 with a belt 26. A person of skill will understand that belt 26 may also be a chain or any other connection that allows for rotation of driven pulley 24 and vertical drive screw 29 when drive pulley 21 is rotated by electric motor. When output drive shaft 18 rotates, driven pulley 24 rotates which causes drive screw 22 attached to the base of driven pulley 24 to rotate.

Figure 2:
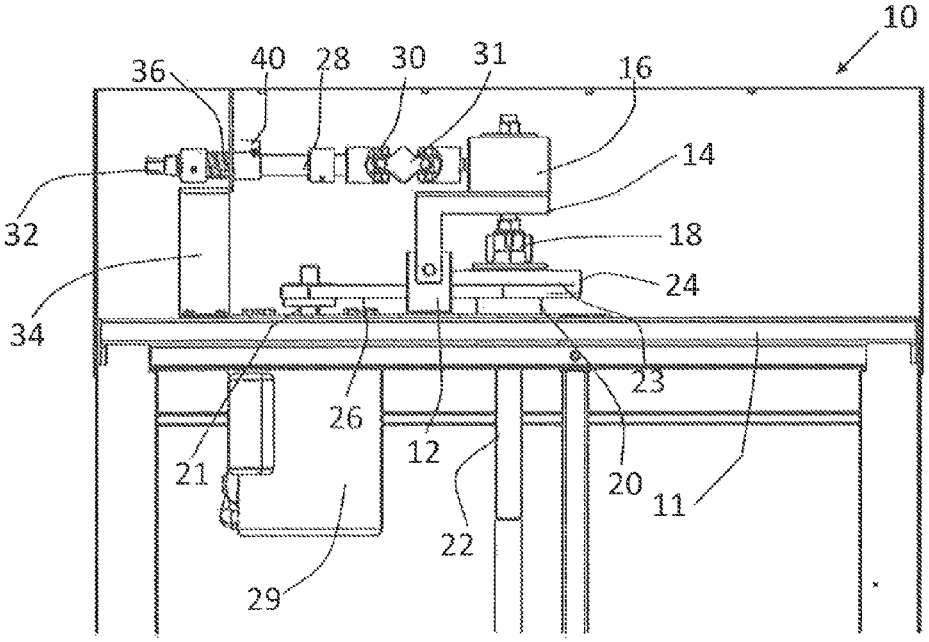
FIG. 2 is a side elevation view of the emergency movement device attached to an elevator in the engaging position.
Figure 3:
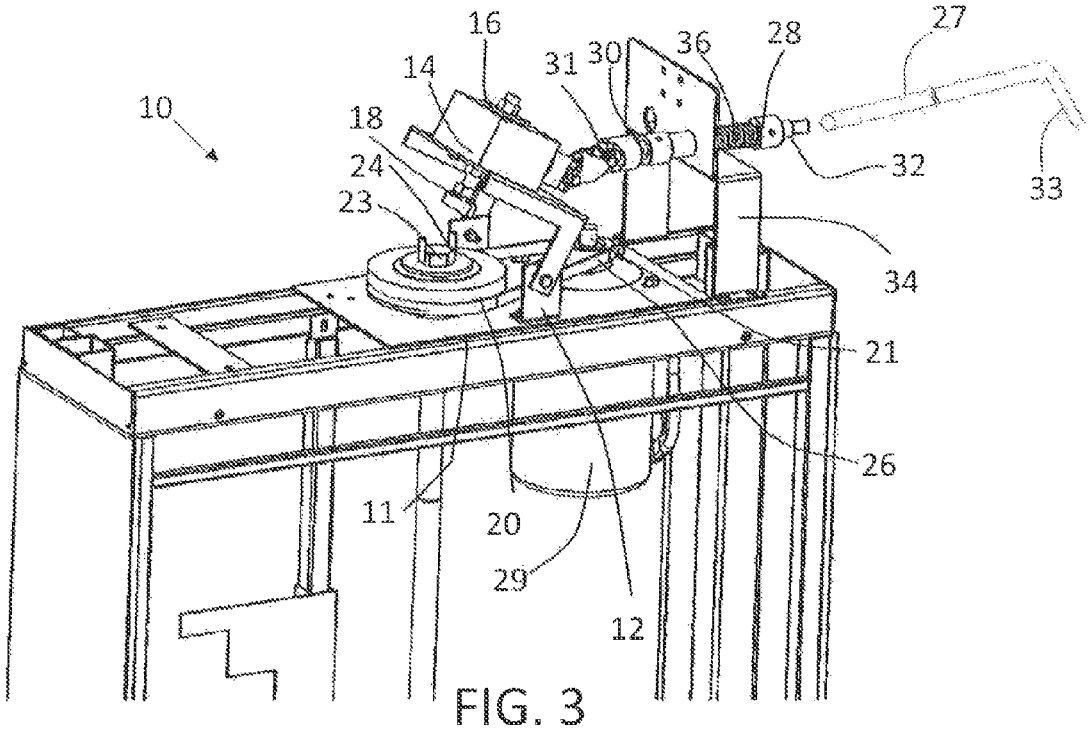
FIG. 3 is a perspective view of the emergency movement device attached to an elevator in the non-engaging position.
Figure 4:
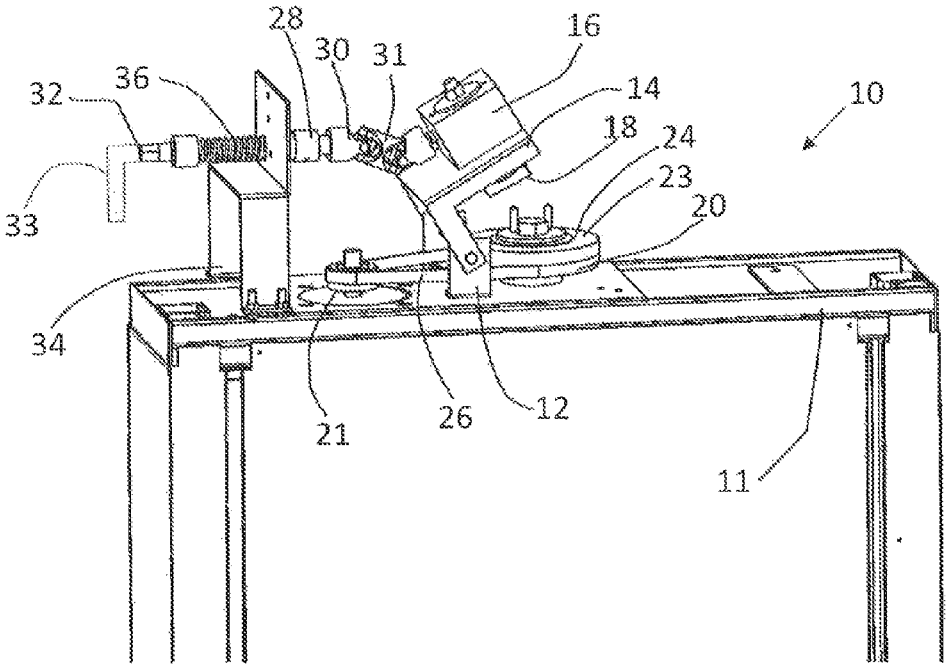
FIG. 4 is a perspective view of the emergency movement device attached to an elevator in the non-engaging position.

Output drive shaft 18 is movable in conjunction with pivoting body 12. Gear box 16 has an output drive shaft 18 that directly or indirectly engages driven pulley 24 of lift 11. Output drive shaft 18 is movable in conjunction with pivoting body 14. Referring to FIG. 1 and FIG. 2, pivoting body 14 is movable between an engaging position in which output drive shaft 18 engages main driven pulley 24 to allow for rotation of drive screw 22 of lift 11 and, referring to FIG. 3 and FIG. 4, a non-engaging position in which output drive shaft 18 is disconnected from driven pulley 24. In the embodiment shown, engagement is shown as output drive shaft 18 engages of pulley drive 23. When in the engaging position, rotation of output drive shaft 18 causes rotation of pulley 24. Rotation of pulley 24 causes rotation of drive screw 22 that is attached to driven pulley 24. An input shaft 28 is provided for rotating output drive shaft 18. Input shaft 28 has a first end 30 and a second end 32 with first end 30 being connected to gear box 16 in such a manner that rotation of input shaft causes rotation of output drive shaft 18. Input shaft 28 is beneficially connected to gear box 16 by a pivotal connection such as a flexible joint 31. Second end 32 of input shaft 28 may be connected to an input shaft extension 27, shown in FIG. 3, for elongating input shaft 28. A handle 33 may be connected to second end 32 of input shaft 28, shown in FIG. 4, or to input shaft extension 27, shown in FIG. 3, to facilitate rotation of input shaft 28. Input shaft 28 may be placed on any side of lift 11 to contend with the possibility of limited or no access on one side or the other. This is particularly important if one side has no platform or landing underneath it or if one side is an exterior wall. Input shaft 28 provides manual operation access at an angle from the direction of main drive screw 22 which is typically vertical. In the embodiment shown, input shaft 28 is positioned at a 90 degree angle to the vertical drive screw. The substantially horizontal input shaft 28 allows for manual operation from the side of lift 11 and may allow for manual operation without needing to climb onto lift 11 to manually activate drive screw 22.

An input shaft support 34 is positioned on lift 11 for providing support to input shaft 28 to support input shaft 28 in a substantially horizontal orientation. A person of skill will understand that some vertical movement of input shaft 28 may occur when pivoting body 14 is moved from the engaged position to the non-engaged position and vice versa. A biasing spring 36 is provided in communication with pivoting body 14 for biasing pivoting body 14 and output drive shaft 18 in the non-engaging position. Biasing spring 36 may be positioned in any location that allows pivoting body 14 to be biased in the non-engaging position. In the embodiment shown, biasing spring 36 is on input shaft 28 and contacts input shaft support 34 to bias pivoting body 14 in non-engaging position. Biasing spring 36 is compressed against input shaft support 34 when pivoting body 14 is moved to the engaging position.

Referring to FIG. 2, a safety switch 40 is provided for preventing power from reaching main drive 20 when emergency movement device 10 is engaged. In the embodiment shown, safety switch 40 engages with input shaft 28 and input shaft support 34. Safety switch 40 reduces the possibility of a user being injured in the event that pivoting body 14 is moved to the engaged position while there is power to main driving 20 by cutting the power if emergency movement device 10 is engaged. Safety switch 40 may be any type of safety switch known in the art. A person of skill would understand what types of safety switch 40 are appropriate and how to correctly include them within emergency movement device 10.

Emergency movement device 10 may be installed on newly manufactured products or can be retrofitted to existing products.

Any use herein of any terms describing an interaction between elements is not meant to limit the interaction to direct interaction between the subject elements, and may also include indirect interaction between the elements such as through secondary or intermediary structure unless specifically stated otherwise.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent that changes may be made to be illustrative embodiments, while falling within the scope of the invention. As such, the scope of the following claims should not be limited by the preferred embodiments set forth in the examples and drawings described above, but should be given the broadest interpretation consistent with the description as a whole.

What is claimed is:

1. An emergency movement device for a lift comprising:

a mounting body attached to the lift;

a pivoting body pivotally attached to the mounting body;

a gear box having an output drive shaft for engaging a main drive of the lift, the output drive shaft being movable in conjunction with the pivoting body;

the pivoting body being movable between an engaging position in which the output drive shaft engages the main drive to allow for rotation of the main drive of the lift and a non-engaging position in which the output drive shaft is disconnected from the main drive;

an input shaft having a first end and a second end, the first end connected to the gear box such that rotation of the input shaft causes rotation of the output drive shaft, and the input shaft causing movement of the pivoting body from the non-engaging position to the engaging position when a force is exerted on the input shaft towards the pivoting body;

an input shaft support on the lift for providing support to the input shaft such that the input shaft is supported in a substantially horizontal orientation;

a biasing spring in communication with the pivoting body for biasing the pivoting body and the output drive shaft in the non-engaging position wherein the output drive shaft engages a pulley drive connected to the main drive.

2. The emergency movement device for a lift of claim 1 wherein the main drive is a screw drive.

3. The emergency movement device for a lift of claim 1 wherein the output drive shaft directly engages the main drive.

4. The emergency movement device for a lift of claim 1 wherein the biasing spring is on the input shaft.

5. The emergency movement device for a lift of claim 1 further comprising a safety switch attached to the input shaft support for preventing power from reaching the main drive when the emergency movement device is engaged.

6. The emergency movement device for a lift of claim 1 wherein an input shaft extension is attached to the second end of the input shaft for elongating the input shaft.

7. The emergency movement device for a lift of claim 1 further comprising a handle for rotation of the input shaft.

8. The emergency movement device for a lift of claim 1 wherein the first end of the input shaft is connected to the gear box by a pivotal connection.

9. The emergency movement device for a lift of claim 8 wherein the pivotal connection is a flexible joint.

10. An emergency movement device for a lift comprising:

a mounting body attached to the lift; a pivoting body pivotally attached to the mounting body;

a gear box on the pivoting body and movable in conjunction with the pivoting body, the gear box having an output drive shaft for engaging a pulley drive connected to a main drive screw of the lift;

the pivoting body being movable between an engaging position in which the output drive shaft engages the pulley drive to allow for rotation of the main drive screw of the lift and a non-engaging position in which the output drive shaft is disconnected from the pulley drive;

an input shaft having a first end and a second end, the first end pivotally connected to the gear box such that rotation of the input shaft causes rotation of the output drive shaft, the input shaft causing movement of the pivoting body from the non-engaging position to the engaging position when a force is exerted on the input shaft towards the pivoting body;

an input shaft support positioned on the lift for providing support to the input shaft such that the input shaft is supported in a substantially horizontal orientation;

a biasing spring on the input shaft for biasing the pivoting body and the output drive shaft in the non-engaging position wherein the output drive shaft engages a pulley drive connected to the main drive.

11. The emergency movement device for a lift of claim 10 further comprising a safety switch attached to the input shaft support for preventing power from reaching the main drive screw when the emergency movement device is engaged.

12. The emergency movement device for a lift of claim 10 wherein an input shaft extension is attached to the second end of the input shaft for elongating the input shaft.

13. The emergency movement device for a lift of claim 10 further comprising a handle for rotation of the input shaft.

14. The emergency movement device for a lift of claim 10 wherein the pivotal connection is a flexible joint.

* * * * *